United States Patent [19]

Schwager

[11] Patent Number: 5,044,047

[45] Date of Patent: Sep. 3, 1991

[54] CAN-FILLING APPARATUS FOR A TEXTILE MACHINE

[75] Inventor: Martin Schwager, Winterthur, Switzerland

[73] Assignee: Maschinefabrik Rieter AG, Winterthur, Switzerland

[21] Appl. No.: 505,143

[22] Filed: Apr. 5, 1990

[30] Foreign Application Priority Data

Apr. 12, 1989 [DE] Fed. Rep. of Germany ..... 3912029

[51] Int. Cl.[5] ..... B65H 54/80

[52] U.S. Cl. ..... 19/159 R

[58] Field of Search ..... 19/159 A, 159 R; 254/98; 311/11; 248/157

[56] References Cited

U.S. PATENT DOCUMENTS

| | | | |
|---|---|---|---|
| 1,245,632 | 11/1917 | Straub | 248/157 |
| 1,879,826 | 9/1932 | Shaffer | 248/354.4 X |
| 2,496,230 | 1/1950 | Peterson | 248/157 |
| 3,583,037 | 6/1971 | Krauss et al. | 19/159 R X |
| 3,955,243 | 5/1976 | Binder | 19/159 R X |
| 4,153,212 | 5/1979 | Bauch et al. | 19/159 R X |
| 4,221,363 | 9/1980 | Jasper | 248/354.4 X |
| 4,244,100 | 1/1981 | Terry | 29/714 |
| 4,497,087 | 2/1985 | Ochy | 19/159 A |
| 4,709,452 | 12/1987 | Cooley et al. | 19/159 R |
| 4,817,248 | 4/1989 | Küpper | 19/159 |
| 4,852,218 | 8/1989 | Lenaertz | 19/159 A |

FOREIGN PATENT DOCUMENTS

| | | | |
|---|---|---|---|
| 629354 | 3/1963 | Belgium | 248/354.4 |
| 0277101 | 8/1988 | European Pat. Off. . | |
| 686961 | 2/1937 | Fed. Rep. of Germany | 19/159 R |
| 1760363 | 12/1971 | Fed. Rep. of Germany . | |
| 2912777 | 10/1979 | Fed. Rep. of Germany | 19/159 R |
| 3542601 | 1/1987 | Fed. Rep. of Germany . | |
| 1213779 | 4/1960 | France | 19/159 R |
| 1136782 | 12/1968 | United Kingdom | 19/159 R |

*Primary Examiner*—Werner H. Schroeder
*Assistant Examiner*—John J. Calvert
*Attorney, Agent, or Firm*—Sandler, Greenblum & Bernstein

[57] ABSTRACT

The can-filling apparatus for a textile machine comprises an upper part supporting a filling head, a lower part structured particularly as an automatic coiler-can exchanger, and at least one upright supporting the upper part and extending between the upper and the lower part. The at least one upright constitutes a telescopic pair of columns structured such that the telescoping displacement of one column relative to the other column of the telescopic pair of columns is infinitely variable. The one column telescopingly displaced relative to the other column can be arrested at a selectable height and, is required, connected to the other column of the telescopic pair of columns.

24 Claims, 7 Drawing Sheets

CAN-FILLING APPARATUS FOR A TEXTILE MACHINE

BACKGROUND OF THE INVENTION

The present invention broadly relates to coiler or sliver cans for textile machines and pertains, more specifically, to a new and improved can-filling apparatus comprising an upper or top part supporting a filling head, a lower or bottom part structured particularly as an automatic coiler-can exchanger, as well as at least one upright or pedestal supporting the upper or top part and extending between the upper or top part and the lower or bottom part.

Coiler-can fillers of this type are widely used and fabricated for different can heights. The fabrication of the can-filling apparatus in different sizes is required in order to ensure adaptability or accommodation to the various can sizes in different spinning mills. Since the sliver or coiler cans come in several different sizes, the need to adapt the operating or working height of the can-filling apparatus leads to various problems with respect to fabrication, storage and spare-part procurement.

SUMMARY OF THE INVENTION

Therefore, with the foregoing in mind, it is a primary object of the present invention to provide a new and improved apparatus for filling a coiler or sliver can or container with filamentary material such as a sliver or the like, which apparatus does not suffer from the aforementioned drawbacks and shortcomings of the prior art constructions.

Another and more specific object of the present invention aims at providing a new and improved construction of a can-filling apparatus for a textile machine, which apparatus is structured for infinitely variable elevational adjustment and thus adaptable to the coiler cans of different heights existing in a spinning mill.

A still further important object of the present invention is directed to providing a new and improved construction of a can-filling apparatus which is relatively simple in construction and design, economical to manufacture, highly reliable in operation, not readily subject to breakdown or malfunction and requires a minimum of maintenance and servicing.

Now in order to implement these and still further objects of the present invention which will become more readily apparent as the description proceeds, the can-filling apparatus of the present invention is manifested, among other things, by the features that the at least one upright or pedestal constitutes a telescopic pair of columns structured such that telescoping displacement of one column of the telescopic pair of columns relative to the other column of the telescopic pair of columns is infinitely variable, whereby means are provided for arresting the one column of the telescopic pair of columns at a selectable or discretionary height and further means are provided for connecting the one column to the other column of the telescopic pair of columns at such selectable or discretionary height.

By virtue of the well-contrived construction of the at least one upright or pedestal in the form of a telescopic pair of columns, it is possible to ensure the required elevational adaptation to the respective can size existing in each case. The technical realization of this construction of the upright or pedestal leads to no appreciable costs, since the telescoping columns can be made of conventional iron or steel tubes and do not turn out to be substantially more expensive than the uprights or pedestals hitherto or presently used.

A particularly preferred exemplary embodiment of the can-filling apparatus, in which the filling head structured as a rotary coiler head and a turntable or rotary plate supporting the coiler can or container are driven by a common motor, whereby the rotary coiler head and the turntable or rotary plate are coupled together or with the common motor by means of drive means, is characterized in that the drive means are lengthwise or linearly adjustable and have a predetermined lengthwise adjustment range which at least corresponds with the telescoping displacement range of the telescopic pair of columns of the at least one upright or pedestal. In this manner, the hollow columns of the telescopic pair of columns are advantageously utilized to accommodate the aforenoted adjustable drive means, so that these adjustable drive means, on the one hand, are protectedly installed and, on the other hand, do not require a special housing or frame.

Although belt or chain arrangements or assemblies with adjustable deflection rolls or rollers are quite suitable for the construction or design of the lengthwise or linearly adjustable drive means, an exemplary embodiment of the can-filling apparatus constructed according to the invention is preferably provided with drive means in the form of a telescopic shaft comprising a longitudinal toothing or teeth. Such a telescopic shaft is economical to manufacture and also renders possible a substantially long displacement range as required for adaptation to coiler cans of different height.

Although it is basically possible to supply a can-filling apparatus without any prefabricated holes in the columns of the at least one upright or pedestal and thus to leave it to the discretion of the customer or user to set in each case the suitable spacing or distance between the upper or top part and the lower or bottom part of the can-filling apparatus and to then fixedly connect the two columns of the telescopic pair of columns at the set height of the upper or top part, for example, by welding or by through-boring and inserting screws or bolts, a preferred embodiment of the can-filling apparatus constructed according to the invention is provided with suitable openings or apertures prior to delivery and installation in a spinning mill or the like.

The provision of such suitable openings or apertures should also be advantageously effected such than an infinitely variable displacement of the columns of the telescopic pair of columns is possible. For example, this can be accomplished in that the openings or apertures constitute oblong or elongated holes or slots provided in advance in one column of the telescopic pair of columns and round or circular holes provided in advance in the other column of the telescopic pair of columns of the at least one upright or pedestal.

Although it is basically possible to provide the round or circular holes in the other or inner column with a suitable screw thread, an exemplary embodiment of the can-filling apparatus constructed according to the invention is preferably provided with nuts mounted at the inner side of the other or inner column, such nuts for fastening screws or bolts being mounted or fixed, for example, by welding. In this manner, the tube used for the other or inner column can be a relatively thin-walled construction, thus providing a corresponding saving in weight.

At least the columns of one telescopic pair of columns of the at least one upright or pedestal are substantially rectangular or square in cross-section. By virtue of such a rectangular or square cross-section of the columns, the heads of the connecting screws or bolts lie flush at the lateral or side wall of the one or outer column, if need be, with suitable washers arranged therebetween. In such case, the washers do not require a special form in order to ensure adaptation, for example, to a round or circular cross-section of the columns. In an arrangement comprising only one telescopic pair of columns, i.e. only one upright or pedestal, such arrangement being readily conceivable, the polygonal cross-section of the columns has the further advantage that a mutual rotation of the upper or top part and the lower or bottom part of the can-filling apparatus relative to one another is impossible, since the upper or top part of the can-filling apparatus is displaceably guided by the column arrangement and secured against rotation.

In a polygonal column there is provided at least one row of holes and, preferably, there are provided two rows of holes per side of the column in at least two sides thereof. In an arrangement containing a plurality of telescopic pairs of columns, i.e. a plurality of uprights or pedestals, there are preferably provided three such telescopic pairs of columns, whereby one telescopic pair of columns is formed of closed tubes and encloses the aforenoted drive means, while the other two telescopic pairs of columns can be structured as C-shaped or U-shaped tracks or channels.

According to a particularly preferred further exemplary embodiment of the can-filling apparatus constructed according to the invention, there is provided at least one lifting device which permits an elevational movement of the upper or top part with respect to the lower or bottom part of the can-filling apparatus.

This at least one lifting device preferably comprises only a limited upstroke or height of lift and ensures that the upper or top part of the can-filling apparatus, i.e. the rotary coiler head, is lifted or raised during automatic can changing, i.e. during removal of an already filled coiler can or container and introduction of a new empty coiler can or container. In this manner, the can-changing process is effected without disturbance or trouble. This at least one lifting device also renders possible that the rotary coiler head, subsequent to accomplishing automatic can changing, can then be lowered onto the spring plate of the empty coiler can or container, so that the first or initial windings of the sliver are correctly effected when the sliver is deposited in the coiler can or container.

The at least one lifting device can be inserted or located, for example, between the upper or top part of the can-filling apparatus and the rotary coiler head, or between the upper or top part of the can-filling apparatus and the top end of the upper column of the respective telescopic pair of columns. The at least one lifting device can also be inserted or located, for example, between the individual columns of the respective telescopic pair of columns, or between the bottom end of the lower column of the respective telescopic pair of columns and the lower or bottom part of the can-filling apparatus.

A further constructional variant is seen in the provision of a relatively long upstroke or height of lift for the at least one lifting device which, for example, is constructed in the form of a threaded or screwed spindle cooperating with a ball or capped nut. In the case of a plurality of telescoping pairs of columns there is preferably provided one lifting device for each telescopic pair of columns, whereby the individual spindles, particularly in the case of threaded or screwed spindles cooperating with respective ball or capped nuts, can be connected with one another by a common drive, for example, by means of a revolving chain, in order to also achieve the required synchronization of the individual threaded or screwed spindles.

In the last described preferred embodiments of the can-filling apparatus, the lifting device not only serves to lift and lower the rotary coiler head during automatic can changing, i.e. during introduction of a new empty can and removal of the full can, but also serves to ensure the desired spacing or distance between the upper or top part and the lower or bottom part of the can-filling apparatus in conformity with the height of the new empty can. In such an arrangement for two lifting operations, the individual threaded or screwed spindles are first set to the respective suitable operating or working height and only then coupled to the motor or motor means effecting the elevational movement, whereby this motor or motor means then only provides for a limited or restricted elevational movement, in order to facilitate the introduction of a new empty can or the removal of the fully filled can.

This limited elevational movement can also be restricted by means of mechanical stops, for example, by means of a pin or bolt which is mounted at the inner column of a telescopic pair of columns and projects into an oblong or enongate hole or slot of the outer column of the telescopic pair of columns, the pin or bolt forming the mechanical stop at the top end and the bottom end of the respective oblong or enongate hole or slot.

In such an arrangement with the oblong hole or slot elevationally moving and the stationary pin or bolt engaging therewith, the motor or motor means could be coupled with the threaded or screwed spindles via a slipping or friction clutch, whereby an elevational movement beyond the mechanical stop and damage to the drive or driving motor or motor means are precluded upon arrival at the mechanical stop. In such an arrangement, a grouping of oblong or elongate holes or slots in the outer column and a grouping of round or circular holes in the inner column, such groupings having different pitch ratios, would be advantageous, since in this manner the pin or bolt can be inserted in each case in conformity with the desired or required can height. Naturally, the reverse arrangement is also conceivable, in which the oblong holes or slots are provided in the inner column of a telescopic pair of columns, while the round or circular holes to accommodate the pin or bolt are provided in the outer column of the telescopic pair of columns.

The use of a lifting device comprising a threaded or screwed spindle cooperating with a ball or capped nut represents only one possibility of realizing the desired or required elevational movement. Scissors-type jacks, for example, can also be positively considered as a variant.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the can-filling apparatus has been illustrated therein as is needed to enable one skilled in the art to readily understand the underlying principles and concepts of this invention.

Figure 1:
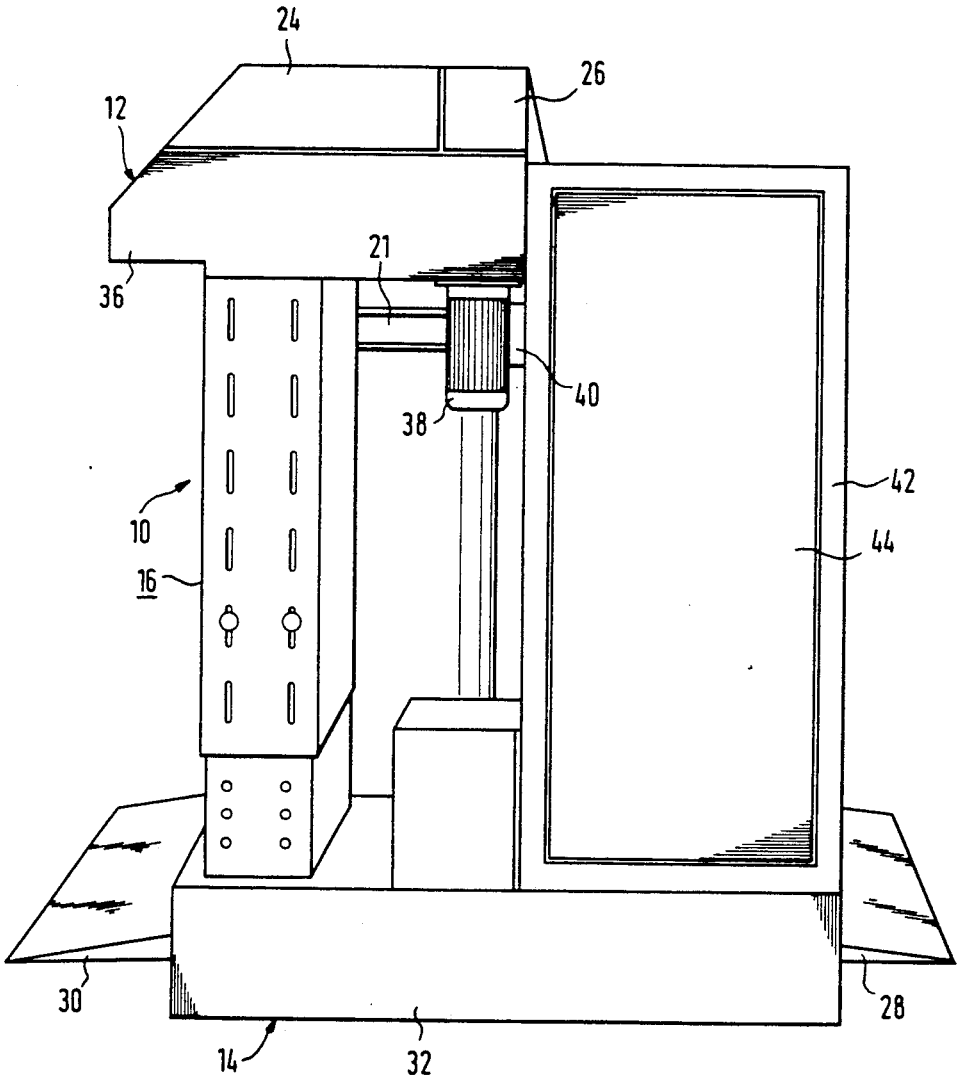
FIG. 1 schematically shows a perspective side view of a first exemplary embodiment of the can-filling apparatus constructed according to the invention.
Figure 2:
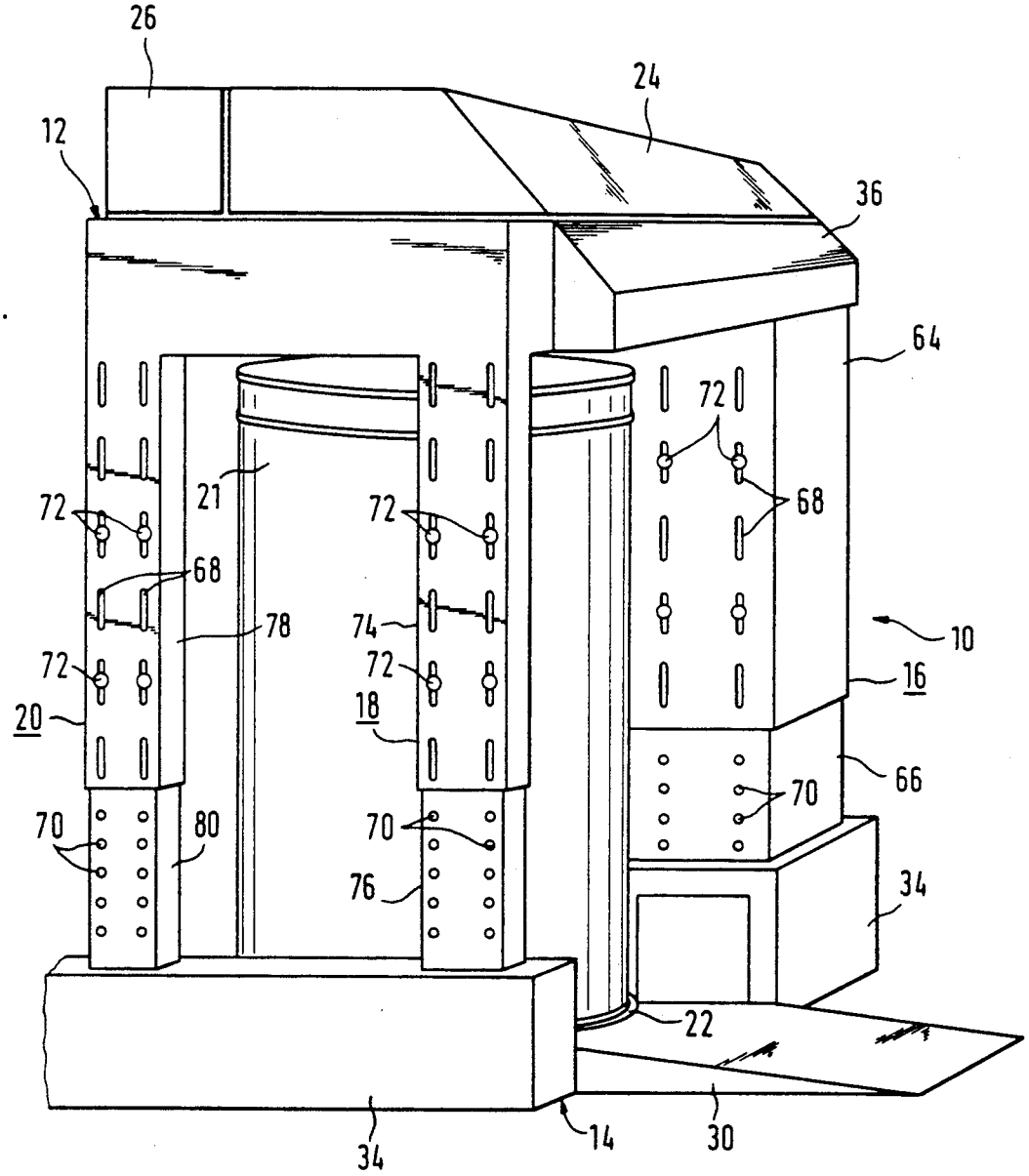
FIG. 2 schematically shows a further perspective side view of the can-filling apparatus depicted in FIG. 1, looking at the opposite side thereof.

Turning attention now specifically to FIGS. 1 and 2 of the drawings, a can-filling apparatus or can coiler 10 illustrated therein by way of example and not limitation comprises an upper or top part 12 and a lower or bottom part 14 which are connected with one another by means of three substantially vertically or perpendicularly extending uprights or pedestals or stands 16, 18 and 20 or equivalent structure, whereby each of these three uprights or pedestals 16, 18 and 20 is structured as a telescopic pair of columns which will be hereinafter described in greater detail.

Beneath the upper or top part 12 there is located a coiler can or container or receptacle 21 standing on a turntable or rotary plate 22 at the lower or bottom part 14 and in which filamentary material, hereinafter generally referred to as a sliver, is deposited in known manner by means of a rotary coiler head or mechanism which is accommodated in the upper or top part 12. For the purpose of providing access to the rotary coiler head, there are located at the upper or top part 12 an upwardly hinged or removeable cover or lid 24 as well as a further cover or lid 26 covering parts of the drive or drive means of the rotary coiler head.

At the entry side and at the exit side of the can-filling apparatus or can coiler 10 there are located respective ramps or sloping platforms 28 and 30 which facilitate the introduction and removal of the coiler cans or containers 21. Within lateral parts or portions 32 and 34 there are located pneumatically actuated drive belts which serve to effect automatic can changing and will not be described here in greater detail.

On the outgoing or discharging side of the can-filling apparatus or can coiler 10 there is mounted at the upper or top part 12 a sliver separating device which serves to sever or cut the sliver upon removal of a fully filled can or container 21. The sliver separating device is known to the art and, therefore, not particularly illustrated in the drawings. However, the housing, in which such sliver separating device is accommodated, is conveniently designated by reference numeral 36.

Figure 7:
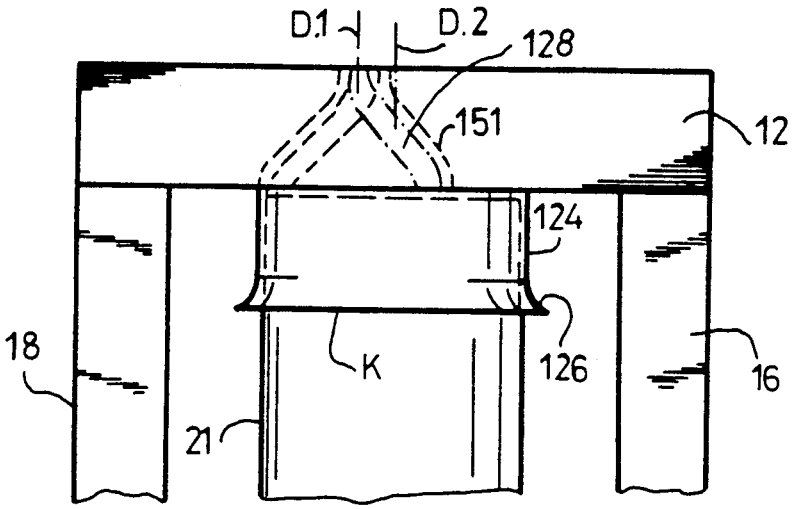
FIG. 7 schematically shows a variant of the third exemplary embodiment of the can-filling apparatus illustrated in FIG. 5.
Figure 8:
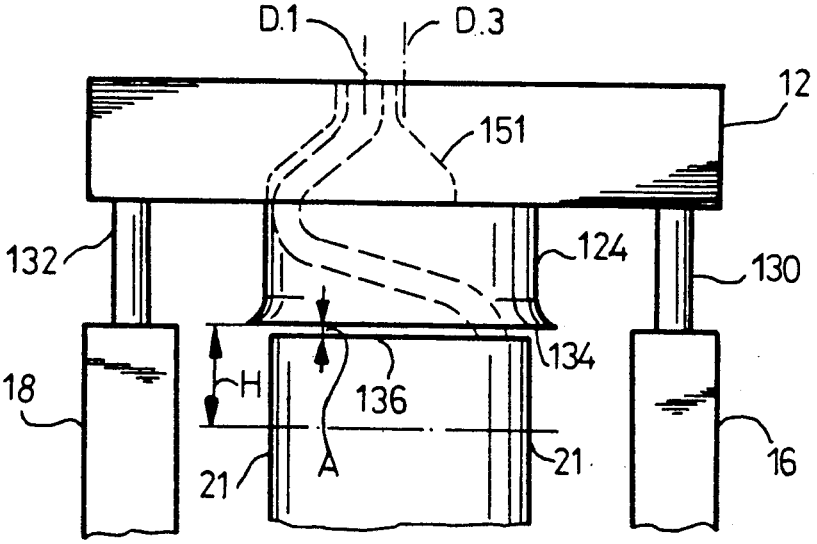
FIG. 8 schematically shows the can-filling apparatus depicted in FIG. 7 and the lifting means thereof in the lifted or raised position.
Figure 9:
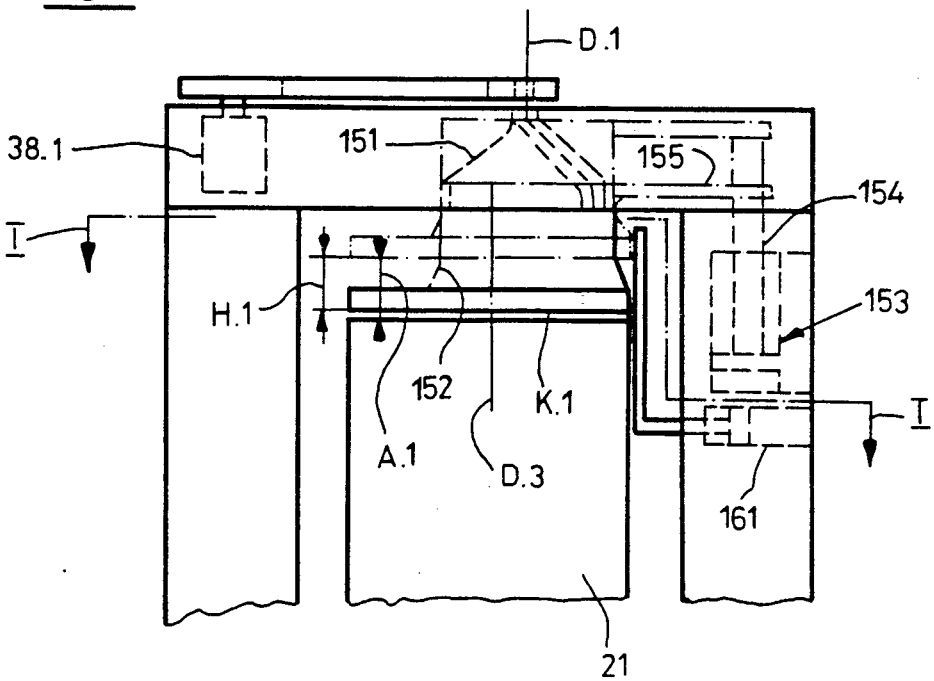
FIG. 9 schematically shows a fragmentary front view of a fourth exemplary embodiment of the can-filling apparatus constructed according to the invention and comprising a third embodiment of lifting means.

As is particularly apparent from FIG. 1, a drive or driving motor 38 for a rotary coiler head 151, depicted in FIGS. 7 through 9, is flange-mounted at the lower side or surface of the upper or top part 12 and receives respective control signals and driving power via a connecting casing or passage 40 to a control and switchgear cabinet 42 comprising a cabinet door 44 which, if desired, can also be equipped with indicator panels, control switches and the like. The drive or driving motor 38 not only serves to drive the rotary coiler head 151, but also to drive the turntable or rotary plate 22, whereby a rotary connection between the drive for the rotary coiler head 151 and the drive for the turntable or rotary plate 22 is provided by means of a substantially perpendicular or vertical shaft 46 which is accommodated in the upright or pedestal 16 and illustrated in FIG. 3.

Figure 3:
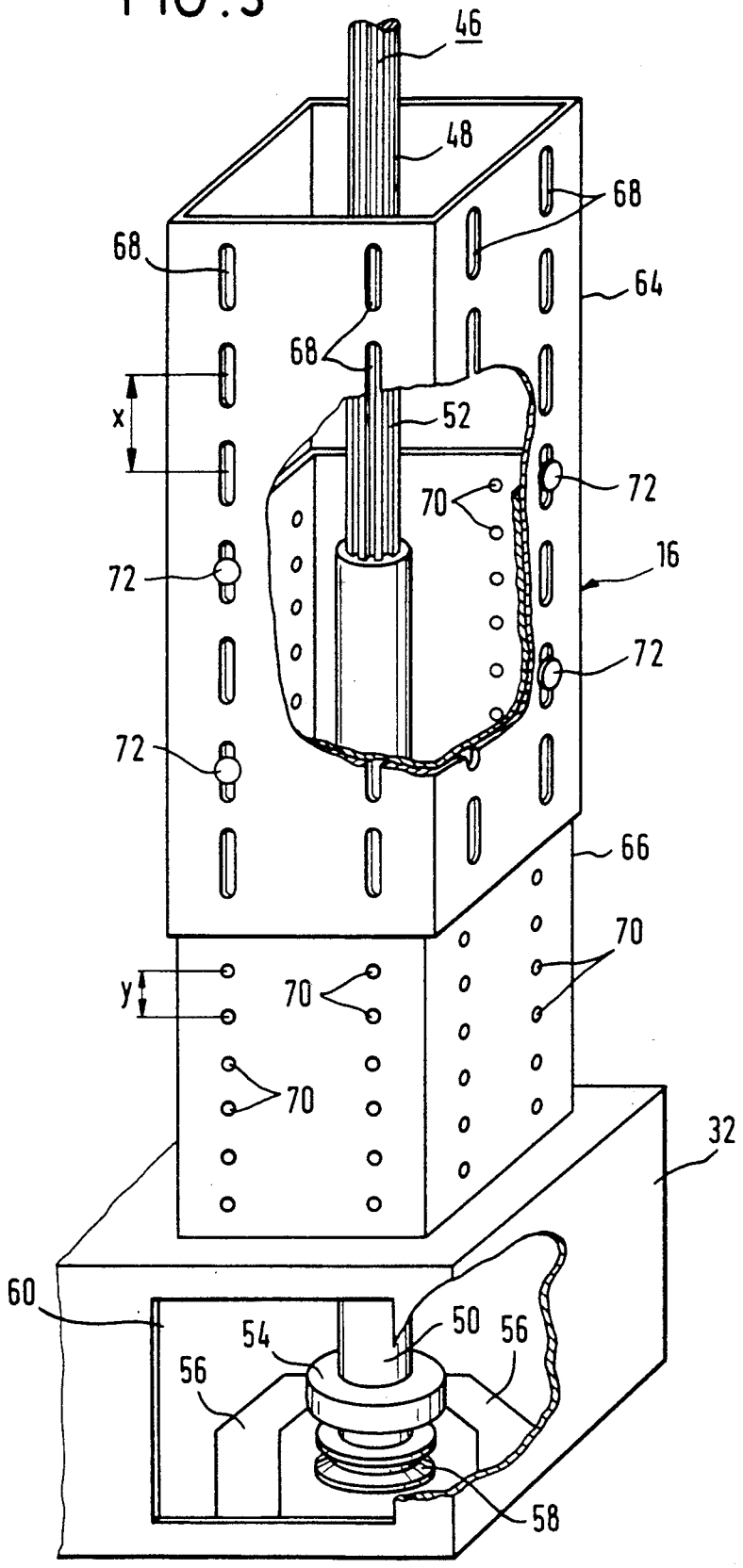
FIG. 3 schematically shows, on an enlarged scale, a perspective view of an upright of the can-filling apparatus depicted in FIGS. 1 and 2, the upright comprising a telescopic pair of columns.

As is apparent from FIG. 3, the substantially perpendicular or vertical shaft 46 is structured as a telescopic shaft comprising two telescoping shaft portions 48 and 50 which, by means of a longitudinal toothing or splines 52, are connected to be nonrotatable relative to one another, but axially displaceable with respect to each other. In other words, the one telescoping shaft portion 50 is structured as a hollow or sleeve shaft 50 possessing an internal longitudinal toothing or teeth, while the other telescoping shaft portion 48 is structured as a bar or rod shaft 48 possessing an external longitudinal toothing or teeth.

The substantially perpendicular or vertical shaft 46 comprising the bar or rod shaft 48 and the hollow or sleeve shaft 50 is mounted at the top end and the bottom end thereof in respective bearings or bearing means, of which only the lower or bottom bearing or bearing means is illustrated in FIG. 3 and conveniently designated by reference numeral 54. The bearing housing or shell of the lower or bottom bearing 54 is mounted by means of supporting or staying members 56 provided at the inner side or wall of the box-type construction of the lateral part or portion 32. Beneath the lower or bottom bearing 54 there is located a belt or drive pulley 58 which is connected to the hollow or sleeve shaft 50 in a manner such as to be nonrotatable relative thereto, and which drives the turntable or rotary plate 22 by means of a cone belt or V-belt not particularly shown in the drawings.

It is readily conceivable that also other driving connections between the hollow or sleeve shaft 50 and the turntable or rotary plate 22, for instance toothed belts or chains or gear wheels, can be considered. An opening 60 provides access to the drive or driving equipment, but such opening 60 is covered by a suitable plate during operation, i.e. at least such part of the opening which is not arranged beneath the ramp or sloping platform 30 and which serves to drive the turntable or rotary plate 22.

As is likewise apparent from FIG. 3, the upright or pedestal or stand 16 comprises a telescopic pair of telescopingly displaceable columns 64 and 66 which are both tubularly structured and possess a square cross-section, whereby the outer cross-sectional dimensions of the sides of the inner column 66 are slightly smaller than the inner cross-sectional dimensions of the sides of the outer column 64.

As can be seen in FIG. 3, each side of the upper outer column 64 comprises two rows of oblong or elongate holes or slots 68, not all of which are illustrated in FIG. 2, whereby the oblong holes or slots 68 of each row are equidistantly arranged relative to each other, and the center-to-center distance of these oblong holes or slots 68 is conveniently designated by reference character x. These oblong holes or slots 68 of the individual rows in one side of the upper outer column 64 are located at the same height as the oblong holes or slots 68 of the individual rows in the other sides of the upper outer column 64.

Each side of the lower inner column 66 likewise comprises two rows of holes 70 which in this arrangement are structured as circular threaded or tapped holes 70. These circular threaded or tapped holes 70 of the individual rows are equidistantly arranged relative to each other, whereby the center-to-center distance of two adjacent or neighboring circular threaded or tapped holes 70 is conveniently designated by reference character y. As shown in FIG. 3, the center-to-center distance y clearly differs from the center-to-center distance x. The center-to-center distance y is selected in comparison with the center-to-center distance x in such a manner that an infinitely variable adjustment of the upper outer column 64 is possible with respect to the lower inner column 66 and that, in each position of the two columns 64 and 66 relative to each other, always two circular threaded or tapped holes 70 can be reached through the oblong hole or slots 68 of the corresponding row of oblong holes or slots 68, so that fastening or fixing screws 72 with respective washers (not shown) can be inserted into the oblong holes or slots 68 and screwed into the circular threaded or tapped holes 70, in order to set and fix the position of the upper outer column 64 with respect to the lower inner column 66 for the can-filling operation. The longitudinal toothing 52 ensures that the substantially perpendicular or vertical shaft 46 is also infinitely variable in length.

The two further uprights or pedestals 18 and 20 are likewise provided with rows of oblong or elongate holes or slots 68 and rows of circular threaded or tapped holes 70 which are arranged in conformity with the rows of oblong holes or slots 68 and the rows of circular threaded or tapped holes 70 in the aforenoted upright or pedestal 16. However, in contrast to the upright or pedestal 16, the columns of the uprights or pedestals 18 and 20 are structured as U-sections or C-sections and comprise only two rows of oblong holes or slots 68 and only two rows of circular threaded or tapped holes 70, respectively, in the bottom or base side of the respective U-sections or C-sections. In such a case, it is not absolutely necessary to structure the circular holes 70 as threaded holes, since access to the rear side of the circular holes 70 exists and, consequently, connection or fastening of the pairs of columns can be effected with conventional screws and nuts.

Since in spinning mills the coiler cans or containers 21 come in several different sizes, the can-filling apparatus 10 installed in a spinning mill must be adjustable to each existing can size. This adaptation to the can size is readily possible by virtue of the telescopic displaceability of the telescopic pairs of columns 64 and 66, 74 and 76, and 78 and 80 of the three uprights or pedestals 16, 18 and 20, respectively. The substantially perpendicular or vertical shaft 46 is also adjusted when the upper or top part 12 is displaced or adjusted with respect to the lower or bottom part 14.

According to experience, depositing the first coils or windings in a can or container 21 always causes certain difficulties, since the spring plate of individual cans or containers 21 is not always in the same position and often protrudes from the can or container 21 such that the spring plate keeps the empty can or container 21 from reaching the operating or working position located underneath the rotary coiler head 151. In order to counteract this difficulty, it is possible, as hereinbefore mentioned, to provide a lifting device which renders possible lifting or raising of the upper or top part 12 with respect to the lower or bottom part 14.

Figure 4:
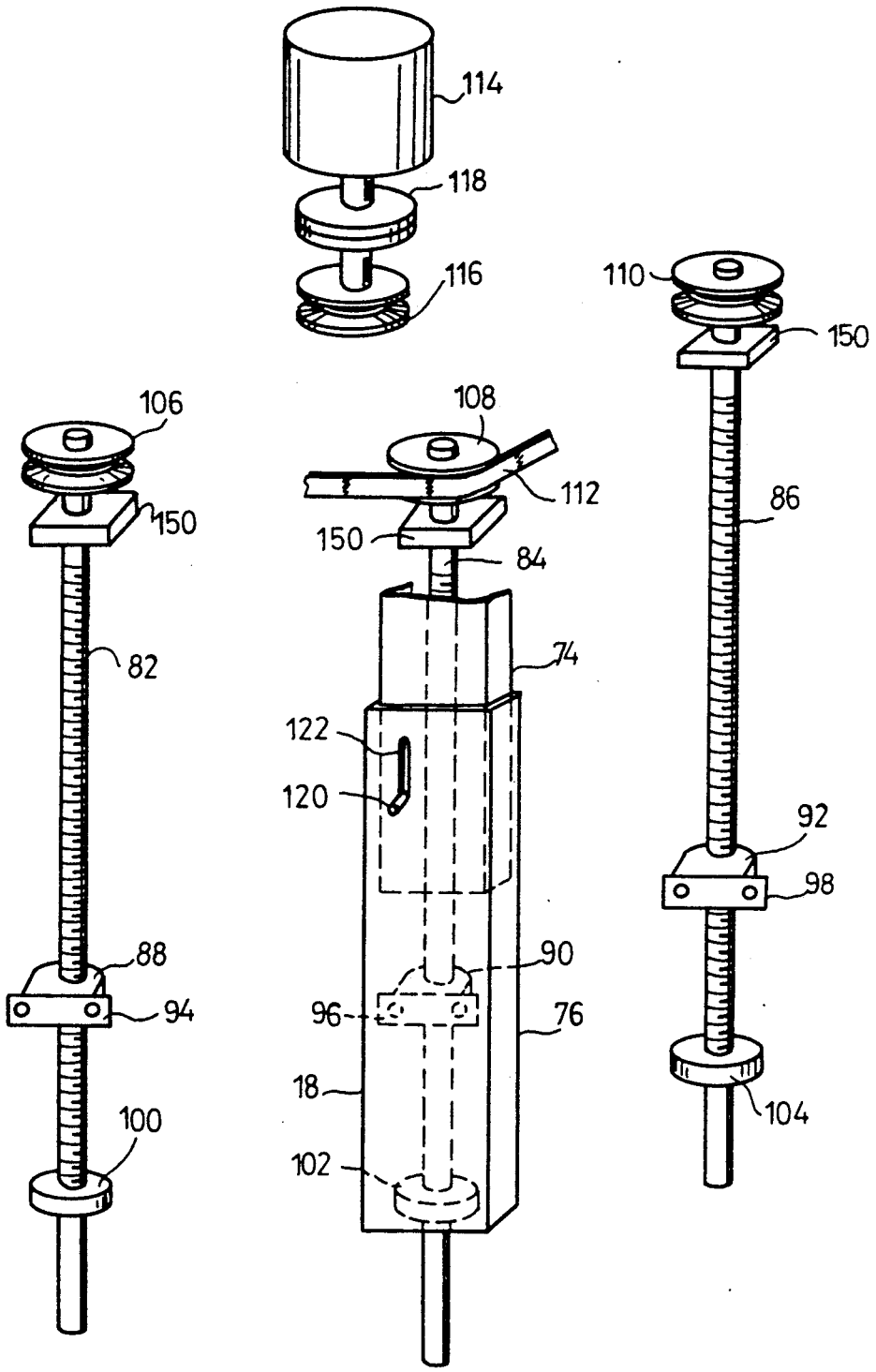
FIG. 4 schematically shows a perspective view of a second exemplary embodiment of the can-filling apparatus constructed according to the invention and comprising a first embodiment of lifting means illustrated in a grossly simplified form.

A possibility of realizing this lifting device as well as the telescopic displaceability of the upper or top part 12 relative to the lower or bottom part 14 is schematically illustrated in FIG. 4. For the purpose of adjusting the upper or top part 12 relative to the lower or bottom part 14, there are provided three threaded or screwed spindles 82, 84 and 86 which are arranged in the hollow spaces or cavities of the respective uprights or pedestals 20, 18 and 16. In the case of the upright or pedestal 16, the threaded or screwed spindle 86 is laterally arranged with respect to the substantially perpendicular shaft 46. For reasons of simplicity only the upright or pedestal 18 is schematically indicated in FIG. 4, whereby in contrast to the previous arrangement the upper column 74 is now arranged within the lower column 76 telescoping therewith. In this embodiment of the can-filling apparatus 10 constructed according to the invention, the uprights or pedestals 18 and 20 can also be structured as hollow supporting columns, in order that the respective threaded or screwed spindles 84 and 82 are entirely enclosed.

At the threaded or screwed spindles 82, 84 and 86 there are provided respective ball or capped nuts 88, 90 and 92 which by means of respective flanges 94, 96 and 98 are mounted at the inner wall of the respective lower columns, of which only the lower column 76 is illustrated in FIG. 4. The lower or bottom ends of the three threaded or screwed spindles 82, 84 and 86 are rotatably and axially displaceably mounted at respective bearings 100, 102 and 104. The upper or top ends of these threaded or screwed spindles 82, 84 and 86 are likewise rotatably mounted in suitable bearings 150 arranged at the upper or top part 12 of the can-filling apparatus 10. However, the three threaded or screwed spindles 82, 84 and 86 are not displaceably arranged at the respective three bearings 150.

All three threaded or screwed spindles 82, 84 and 86 support at the top ends thereof respective belt or drive pulleys 106, 108, and 110 which are coupled together by means of a cone belt or V-belt 112. Such cone belt or V-belt 112 is also guided around a belt or drive pulley 116 provided at the drive or driving shaft of a motor 114 and tensioned by a further suitable but not particularly illustrated tightener pulley, so that no slip can occur and all four belt pulleys 106, 108, 110 and 116 together with the tightener pulley are synchronously drivable. It is readily conceivable that, for this purpose, toothed belts or drive chains or even gear wheels can just as well be used. A slipping or friction clutch 118 is advantageously provided between the drive or driving motor 114 and the belt or drive pulley 116.

To begin with during installation of the can-filling apparatus or can coiler 10, the three threaded or screwed spindles 82, 84 and 86 are driven by the drive or driving motor 114 until all three ball or capped nuts 88, 90 and 92 reach the desired operating or working height or level, whereby this operating or working height or level is preferably the same for all three threaded or screwed spindles 82, 84 and 86. Thereafter, preferably in each outer column, a pin or bolt 120, as depicted in FIG. 4 only in conjunction with an oblong or elongate hole or slot 122 of the outer column 76, is inserted into a respective oblong hole or slot 122 provided in the respective outer column and screwed into a circular tapped or threaded hole in the respective inner column. For this purpose, all columns comprise, as in the previously discussed embodiment, oblong holes or circular tapped holes arranged in each column in such a manner that, in all relative positions of the telescoping columns of each of the uprights or pedestals 16, 18 and 20, there can always be found at least one oblong hole or slot 122 in which the corresponding pin or bolt 120 can be inserted into a circular tapped hole located at the upper or top end of the respective oblong hole or slot 122. The length of the respective oblong hole or slot 122 then limits the permissible adjusting upstroke between the telescopic pairs of columns.

In operation, to begin with and for the purpose of automatic can changing, the drive or driving motor 114 is driven in order to lift or raise, by means of the cone belt or V-belt 112, the upper or top part 12 of the can-filling apparatus 10 relative to the lower or bottom part 14 thereof. The upward travel of the upper or top part 12 is continued until the pins or bolts 120 bear against the bottom end portions of their respective oblong holes or slots 122. At this instant, the friction clutch 118 slips, such slipping being detected and utilized to switch off the drive or driving motor 114. After removal of the full coiler can 21 and introduction of an empty coiler can 21, the direction of rotation of the drive or driving motor 114 is reversed and the upper or top part 12 is again lowered by the rotation of the three threaded or screwed spindles 82, 84 and 86 until the pins or bolts 120 bear against the top end portions of their respective oblong holes or slots 122, this representing the operating or working height of the can-filling apparatus 10. At the end of the downward travel of the upper or top part 12, i.e. as soon as the pins or bolts 120 bear against the top end portions of the oblong holes or slots 122, the friction clutch 118 also slips and this is likewise detected and utilized to switch off the drive or driving motor 114.

Figure 5:
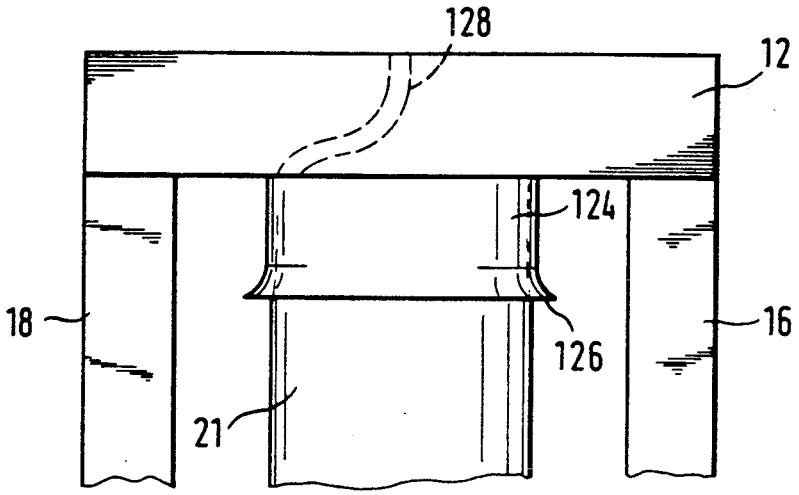
FIG. 5 schematically shows a fragmentary front view of a third exemplary embodiment of the can-filling apparatus constructed according to the invention and comprising a second embodiment of lifting means illustrated in the lowered position thereof.
Figure 6:
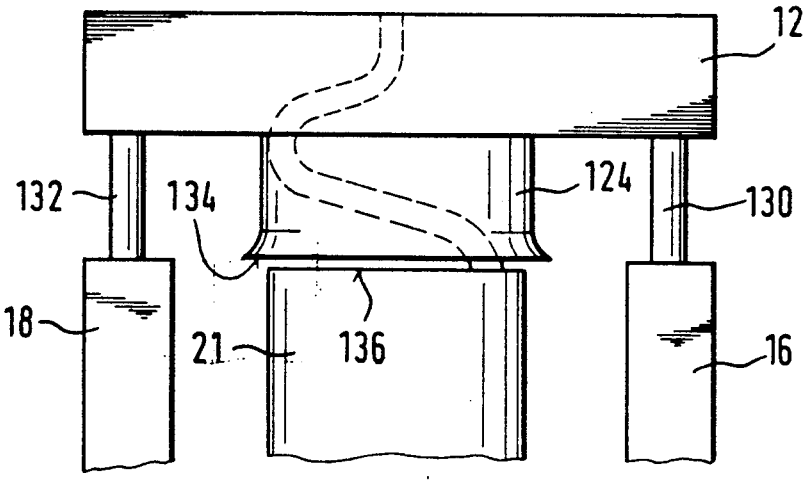
FIG. 6 schematically shows the can-filling apparatus depicted in FIG. 5 and the lifting means thereof in the lifted or raised position.

A further possibility of elevationally adjusting the upper or top part 12 of the can-filling apparatus 10 for the purpose of trouble-free introduction of an empty coiler can 21 is schematically illustrated in FIGS. 5 and 6. As can be seen in FIG. 5, the upper or top part 12 comprises a cylindrical hood or dome 124 containing a trumpet-shaped infeeding end 126 which fits the top edge 136 of the coiler can or container 21 and thus centers the coiler can or container 21 relative to the rotary coiler head 151 and facilitates or promotes the deposition of a sliver 128 in the coiler can or container 21.

For the purpose of removing the coiler can or container 21, the upper or top part 12 can be lifted or raised by means of the lifting system depicted in FIG. 4 and hereinbefore described or, for example, by means of two piston-and-cylinder units or devices 130 and 132 arranged between the top ends of the uprights or pedestals 16 and 18, and the upper or top part 12 of the can-filling apparatus 10. The upstroke or height of lift is selected such that the bottom edge 134 of the cylindrical hood or dome 124 comes to lie distinctly above the top edge 136 of the coiler can or container 21. In this embodiment of the can-filling apparatus 10 the uprights or pedestals 16 and 18 and the not particularly illustrated third upright or pedestal 20 essentially correspond with the uprights or pedestals 16, 18 and 20 of the embodiments depicted in FIGS. 1 through 3. It is readily apparent that the substantially perpendicular or vertical shaft 46 also permits this elevational movement by suitably dimensioning the longitudinal toothing or splines 52.

It is not imperative that the piston-and-cylinder units or devices 130 and 132 as well as the further piston-and-cylinder unit or device for the third upright or pedestal 20 (not shown) are arranged between the top ends of the uprights or pedestals 16, 18 and 20 and the upper or top part 12 of the can-filling apparatus 10. These three piston-and-cylinder units or devices can just as well be arranged between the bottom ends of these uprights or pedestals 16, 18 and 20 and the lower or bottom part 14 of the can-filling apparatus 10, or arranged within the uprights or pedestals 16, 18 and 20, i.e. between the columns of the respective telescopic pairs of columns. These variants of the piston-and-cylinder units or devices are not particularly illustrated in the drawings.

Furthermore, it is readily conceivable that it is not imperative to provide three uprights or pedestals 16, 18 and 20. In the simplest embodiment of the can-filling apparatus 10, it should be possible to get by with even one upright or pedestal, provided, this one upright or pedestal is a sufficiently stable construction. This would be by all means possible based on the practicably selectable cross-sectional dimensions of the telescopic pair of columns of the upright or pedestal 16. Two rotary coiler heads 151 could also be provided for simultaneously filling two coiler cans or containers 21, such rotary coiler heads 151 being arranged at a single telescopic pair of columns centered between the two rotary coiler heads 151, so that the telescopic pair of columns would not have to support any bending or flexural moments.

FIGS. 7 and 8 schematically show a variant of the exemplary embodiment of the can-filling apparatus 10 depicted in FIGS. 5 and 6. In this variant the rotary coiler head 151 rotates about the axis of rotation D.1 thereof, and this axis of rotation D.1, in turn, rotates about an axis of rotation D.2, so that the sliver can be progressively deposited in loops in known manner into a stationary can or container 21. This method of depositing sliver is known to the art.

A spacing A shown in FIG. 8 is formed after lifting or raising the upper or top part 12 together with the cylindrical hood or dome 124 by a height of lift H. This spacing A is selected such that coiler cans or containers 21 with variably protruding spring plates (not shown) can be changed without difficulty.

Figure 10:
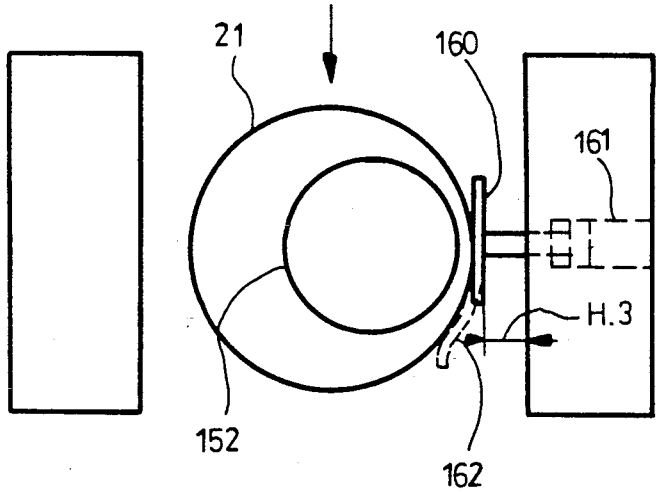
FIG. 10 schematically shows a top plan view of the can-filling apparatus depicted in FIG. 9, looking in the direction of the arrows I—I shown in FIG. 9.

FIGS. 9 and 10 schematically show a further exemplary embodiment of the can-filling apparatus 10 in which the coiler can or container 21 rotates about its axis of symmetry D.3, while the rotary coiler head 151 solely rotates about its own axis D.1.

Therefore, for guiding the sliver there is provided a sliver guiding device, namely a cylindrical hood or dome 152 which is eccentrically arranged with respect to the axis of symmetry D.3 of the coiler can or container 21.

The cylindrical hood or dome 152 is connected via a connecting member 155 to a piston 154 of a piston-and-cylinder unit or device 153 which, in turn, is fixedly arranged at a housing part or portion. The cylindrical hood or dome 152 covers the path of an upstroke H.1 by means of the piston-and-cylinder unit or device 153, so that a spacing A.1 results for facilitating automatic can changing. The rotary coiler head 151 is driven by a driving or driving motor 38.1.

An additional sliver guidance is provided by a guide plate 160 which, in the raised or lifted position of the cylindrical hood or dome 152, guides the sliver for the moment of lifting the hood or dome 152 at least such that the sliver cannot be outwardly slung or hurled through the interspace defined by the spacing A.1.

If the guide plate 160 is structured as shown in full lines in FIG. 10, then this guide plate 160 can be fixedly arranged at the housing or frame of the can-filling apparatus 10. However, if the guide plate 160 is provided with an additional extension 162 shown in broken lines in FIG. 10, then the guide plate 160 would require a piston-and-cylinder unit or device 161 in order to carry out automatic can changing. This piston-and-cylinder unit or device 161 is, on the one hand, fixedly arranged at the housing or frame of the can-filling apparatus 10 and retracts, on the other hand, the guide plate 160 toward the housing or frame by a stroke length H.3, so that the coiler can or container 21 can be guided past the extension 162.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A can-filling apparatus for a textile machine, comprising:

an upper part;

a filling head supported by said upper part;

a lower part constructed as an automatic coiler-can exchanger;

at least one upright supporting said upper part and extending between said upper part and said lower part;

said at least one upright constituting a telescopic pair of columns, said pair of columns including one column and an other column;

said telescopic pair of columns being structured such that telescoping displacement of said one column relative to said other column of said telescopic pair of columns is infinitely variable;

means for arresting said one column of said telescopic pair of columns at a selectable height;

means for connecting said one column to said other column of said telescopic pair of columns at said selectable height;

said telescopic pair of columns each having a plurality of apertures;

said means for connecting said one column to said other column of said telescopic pair of columns constitutes a plurality of threaded connection means;

said plurality of threaded connection means extending through respective apertures of said plurality of apertures of said columns of said telescopic pair of columns;

said plurality of apertures of said one column of said telescopic pair of columns constitute a plurality of oblong holes;

said plurality of apertures of said other column of said telescopic pair of columns constitute a plurality of round holes; and said infinitely variable telescoping displacement of said one column relative to said other column of said telescopic pair of columns of said at least one upright is rendered possible by said plurality of apertures of said columns of said telescopic pair of columns.

2. The can-filling apparatus as defined in claim 1, wherein:

said plurality of apertures of each telescopic pair of columns are provided in said telescopic pair of columns prior to installation of the can-filling apparatus in a spinning mill.

3. The can-filling apparatus as defined in claim 1, wherein:

said plurality of oblong holes are arranged equidistantly from one another at said one column of said telescopic pair of columns;

said plurality of round holes are arranged equidistantly from one another at said other column of said telescopic pair of columns;

said equidistantly arranged plurality of oblong holes having a first predetermined center-to-center distance;

said equidistantly arranged plurality of round holes having a second predetermined center-to-center distance; and said first predetermined center-to-center distance and second predetermined center-to-center distance being selectively determined to be of different length.

4. The can-filling apparatus as defined in claim 3, wherein:

said equidistantly arranged plurality of round holes constitute a plurality of circular tapped holes.

5. The can-filling apparatus as defined in claim 3, wherein:

said other column of said telescopic pair of columns of said at least one upright constitutes an inner hollow column telescoping with said one column of said telescopic pair of columns;

said inner hollow column having an inner wall;

said plurality of threaded connection means constituting a plurality of screws; and a plurality of nuts for said plurality of screws being provided at said inner wall of said hollow column.

6. The can-filling apparatus as defined in claim 5, wherein:

said plurality of nuts for said plurality of screws are welded to said inner wall.

7. The can-filling apparatus as defined in claim 5, wherein:

at least said columns of said telescopic pair of columns of said at least one upright are structured to be polygonal in cross-section.

8. The can-filling apparatus as defined in claim 7, wherein:

said polygonal cross-section constitutes a rectangular cross-section.

9. The can-filling apparatus as defined in claim 7, wherein:

said polygonal cross-section constitutes a square cross-section.

10. The can-filling apparatus as defined in claim 7, wherein:

said plurality of oblong holes constitute a plurality of rows of oblong holes;

said plurality of round holes constitute a plurality of rows of round holes;

at least one row of oblong holes being provided in each of at least two sides of said one column of said telescopic pair of columns having a polygonal cross-section;

at least one row of round holes being provided in each of at least two sides of said other column of said telescopic pair of columns having a polygonal cross-section.

11. The can-filling apparatus as defined in claim 7, wherein:

said plurality of oblong holes constitute a plurality of rows of oblong holes;

said plurality of round holes constitute a plurality of rows of round holes;

two rows of oblong holes being provided in each of at least two sides of said one column of said telescopic pair of columns having a polygonal cross-section; and two rows of round holes being provided in each of at least two sides of said other column of said telescopic pair of columns having a polygonal cross-section.

12. A can-filling apparatus for a textile machine for filling sliver into a can having a top edge, comprising:

an upper part;

a filling head supported by said upper part;

a lower part constructed as an automatic coiler-can exchanger;

at least one upright supporting said upper part and extending between said upper part and said lower part;

at least one sliver guiding device arranged at said upper part;

said sliver guiding device having a bottom edge for cooperating with said can adjacent said top edge of said can;

lifting means for lifting said at least one sliver guiding device by a predetermined upstroke within a predetermined infinitely variable range;

said sliver guiding device at the end of said predetermined upstroke assuming a predetermined elevated position; and said bottom edge of said sliver guiding device in said predetermined elevated position defining with said top edge of the can a predetermined spacing.

13. The can-filling apparatus as defined in claim 12, wherein:

said lifting means are provided for carrying out an elevational movement of said upper part with respect to said lower part.

14. The can-filling apparatus as defined in claim 13, wherein:

said lifting means possess a limited upstroke;

said at least one upright constituting a telescopic pair of columns;

said telescopic pair of columns comprising an upper column and a lower column;

said upper column having an upper end; and said lifting means being arranged in the upper part of said upper end of said upper column.

15. The can-filling apparatus as defined in claim 13, wherein:

said lifting means possess a limited upstroke;

said at least one upright constituting a telescopic pair of columns;

said telescopic pair of columns comprising an upper column and a lower column;

said upper column having a top end; and said lifting means being arranged between said upper part and said top end of said upper column.

16. The can-filling apparatus as defined in claim 12, wherein:

said filling head constitutes a rotary coiler head; and said at least one sliver guiding device constituting a hood guiding the sliver between said rotary coiler head and the can.

17. The can-filling apparatus as defined in claim 16, wherein:

said hood is mounted at said upper part; and said predetermined upstroke being effected by said upper part.

18. The can-filling apparatus as defined in claim 16, further including:

means provided at said upper part for moving said hood to perform said predetermined upstroke.

19. The can-filling apparatus as defined in claim 12, further including:

a sliver guiding member for at least partially covering said predetermined spacing between said top edge of the can and said bottom edge of said sliver guiding device in said predetermined elevated position.

20. A can-filling apparatus for a textile machine for filling sliver into a can having a top edge, comprising:

an upper part;

a filling head supported by said upper part;

a lower part constructed as an automatic coiler-can exchanger;

at least one upright supporting said upper part and extending between said upper part and said lower part;

at least one sliver guiding device arranged at said upper part;

said sliver guiding device having a bottom edge;

lifting means for lifting said at least one sliver guiding device by a predetermined upstroke;

said lifting means are provided for carrying out an elevational movement of said upper part with respect to said lower part;

said at least one upright constitutes a telescopic pair of columns;

said telescopic pair of columns comprising an inner and an outer column;

said lifting means being located between said inner column and said outer column of said telescopic pair of columns;

at least one pin provided at said inner column;

said outer column having an oblong hole;

said at least one pin engaging in said oblong hole of said outer column and thus defining a top end and a bottom end of said elevational movement;

said sliver guiding device at the end of said predetermined upstroke assuming a predetermined elevated position; and said bottom edge of said sliver guiding device in said predetermined elevated position defining with said top edge of the can a predetermined spacing.

21. The can-filling apparatus as defined in claim 20, wherein:

said telescopic pair of columns comprises a predetermined telescoping displacement range; and said lifting means having an upstroke which is at least as long as said predetermined telescoping displacement range.

22. The can-filling apparatus as defined in claim 21, further including:

a rotatable threaded spindle;

a ball nut cooperating with said rotatable threaded spindle;

a bearing for said rotatable threaded spindle; and said rotatable threaded spindle together with said ball nut and said bearing constituting said lifting means.

23. The can-filling apparatus as defined in claim 22, wherein:

said rotatable threaded spindle constitutes a plurality of rotatable threaded spindles; and common drive means for synchronously driving said plurality of rotatable threaded spindles.

24. A can-filling apparatus for a textile machine, comprising:

an upper part;

a filling head supported by said upper part;

a lower part constructed as an automatic coiler-can exchanger;

at least one upright supporting said upper part and extending between said upper part and said lower part;

said at least one upright constituting a telescoping pair of columns, said pair of columns including one column and an other column;

said telescopic pair of columns being structured such that telescoping displacement of said one column relative to said other column of said telescopic pair of columns is infinitely variable;

means for arresting said one column of said telescoping pair of columns at a selectable height;

means for connecting said one column to said other column of said telescopic pair of columns at said selectable height;

said at least one upright constitutes three uprights;

said three uprights constituting three telescopic pairs of columns;

a can arranged below said filling head; and said three telescopic pairs of columns being distributedly arranged around the can such that a spacing between said three telescopic pairs of columns is provided for can passage during change of cans;

at least one of said three telescopic pairs of columns comprises a closed tubular cross-section; and the other two of said three telescopic pairs of columns selectively comprising at least one of a closed tubular cross-section or an open cross-section, said open cross-section selectively constituting at least one of a C-shaped cross-section or a U-shaped cross-section.

* * * * *